United States Patent [19]

Klimpel et al.

[11] Patent Number: 5,057,209

[45] Date of Patent: Oct. 15, 1991

[54] DEPRESSION OF THE FLOTATION OF SILICA OR SILICEOUS GANGUE IN MINERAL FLOTATION

[75] Inventors: Richard R. Klimpel, Midland; Donald E. Leonard, Shepherd; Robert D. Hansen, Waters, all of Mich.; Basil S. Fee, Sarnia, Canada

[73] Assignee: The Dow Chemical Company, Midland, Mich.

[21] Appl. No.: 484,012

[22] Filed: Feb. 23, 1990

Related U.S. Application Data

[63] Continuation-in-part of Ser. No. 336,196, Apr. 11, 1989, abandoned, which is a continuation-in-part of Ser. No. 310,271, Feb. 13, 1989, abandoned.

[51] Int. Cl.[5] ..... B03D 1/01; B03D 1/008; B03D 1/02

[52] U.S. Cl. ..... 209/167; 209/166; 252/61

[58] Field of Search ..... 209/166, 167; 252/61

[56] References Cited

U.S. PATENT DOCUMENTS

| | | | |
|---|---|---|---|
| 1,102,874 | 7/1914 | Chapman | 209/166 |
| 2,014,405 | 9/1935 | Weed | 209/166 |
| 2,074,699 | 3/1937 | Lenher et al. | 209/166 |
| 2,173,909 | 9/1939 | Kritchevsky | 209/166 |
| 2,182,845 | 12/1939 | Harris | 209/166 |
| 2,335,485 | 11/1943 | Christman | 209/166 |
| 2,377,129 | 5/1945 | Christmann et al. | 209/166 |
| 2,385,819 | 10/1945 | Lamb | 209/166 |
| 4,081,363 | 3/1978 | Grayson | 209/166 |
| 4,110,207 | 8/1978 | Wang et al. | 209/166 |
| 4,139,482 | 2/1979 | Holme | 252/61 |
| 4,158,623 | 6/1979 | Wang et al. | 209/166 |
| 4,172,029 | 10/1979 | Hefner, Jr. | 209/166 |
| 4,276,156 | 6/1981 | Hefner, Jr. | 209/166 |
| 4,507,198 | 3/1985 | Unger et al. | 209/166 |

FOREIGN PATENT DOCUMENTS

| | | | |
|---|---|---|---|
| 378252 | 8/1971 | U.S.S.R. | 209/166 |
| 649469 | 6/1977 | U.S.S.R. | 209/166 |
| 1050751 | 5/1982 | U.S.S.R. | 209/166 |
| 1058136 | 4/1985 | U.S.S.R. | 209/166 |
| 1356915 | 6/1974 | United Kingdom | 209/166 |

*Primary Examiner*—Stanley S. Silverman
*Assistant Examiner*—Thomas M. Lithgow

[57] ABSTRACT

A flotation process is disclosed wherein the selectivity to the valuable mineral is improved by the depression of silica or siliceous gangue by the use of a hydroxy-containing compound such as an alkanol amine. The process is useful in the flotation of oxide minerals as well as in sulfide flotation.

21 Claims, No Drawings

DEPRESSION OF THE FLOTATION OF SILICA OR SILICEOUS GANGUE IN MINERAL FLOTATION

CROSS-REFERENCE TO RELATED APPLICATIONS

This is a continuation in part of co-pending application Ser. No. 336,196, filed Apr. 11, 1989 (now abandoned) which was a continuation in part of co-pending application Ser. No. 310,271, filed Feb. 13, 1989, now abandoned.

BACKGROUND OF THE INVENTION

This invention is related to the recovery of minerals by froth flotation.

Flotation is a process of treating a mixture of finely divided mineral solids, e.g., a pulverulent ore, suspended in a liquid whereby a portion of the solids is separated from other finely divided mineral solids, e.g., silica, siliceous gangue, clays and other like materials present in the ore, by introducing a gas (or providing a gas in situ) in the liquid to produce a frothy mass containing certain of the solids on the top of the liquid, and leaving suspended (unfrothed) other solid components of the ore. Flotation is based on the principle that introducing a gas into a liquid containing solid particles of different materials suspended therein causes adherence of some gas to certain suspended solids and not to others and makes the particles having the gas thus adhered thereto lighter than the liquid. Accordingly, these particles rise to the top of the liquid to form a froth.

The minerals and their associated gangue which are treated by froth flotation generally do not possess sufficient hydrophobicity or hydrophilicity to allow adequate separation. Therefore, various chemical reagents are often employed in froth flotation to create or enhance the properties necessary to allow separation. Collectors are used to enhance the hydrophobicity and thus the floatability of different mineral values. Collectors must have the ability to (1) attach to the desired mineral species to the relative exclusion of other species present: (2) maintain the attachment in the turbulence or shear associated with froth flotation; and (3) render the desired mineral species sufficiently hydrophobic to permit the required degree of separation.

A number of other chemical reagents are used in addition to collectors. Examples of types of additional reagents used include frothers, depressants, pH regulators, such as lime and soda, dispersants and various promoters and activators. Depressants are used to increase or enhance the hydrophilicity of various mineral species and thus depress their flotation. Frothers are reagents added to flotation systems to promote the creation of a semi-stable froth. Unlike both depressants and collectors, frothers need not attach or adsorb on mineral particles.

Froth flotation has been extensively practiced in the mining industry since at least the early twentieth century. A wide variety of compounds are taught to be useful as collectors, frothers and other reagents in froth flotation. For example, xanthates, simple alkylamines, alkyl sulfates, alkyl sulfonates, carboxylic acids and fatty acids are generally accepted as useful collectors. Reagents useful as frothers include lower molecular weight alcohols such as methyl isobutyl carbinol and glycol ethers. The specific additives used in a particular flotation operation are selected according to the nature of the ore, the conditions under which the flotation will take place, the mineral sought to be recovered and the other additives which are to be used in combination therewith.

While a wide variety of chemical reagents are recognized by those skilled in the art as having utility in froth flotation, it is also recognized that the effectiveness of known reagents varies greatly depending on the partioular ore or ores being subjected to flotation as well as the flotation conditions. It is further recognized that selectivity or the ability to selectively float the desired species to the exclusion of undesired species is a particular problem.

Minerals and their associated ores are generally categorized as sulfides or oxides, with the latter group including carbonates, hydroxides, sulfates and silicates. While a large proportion of the minerals existing today are contained in oxide ores, the bulk of successful froth flotation systems is directed to sulfide ores. The flotation of oxide minerals is recognized as being substantially more difficult than the flotation of sulfide minerals and the effectiveness of most flotation processes in the recovery of oxide ores is limited.

A major problem associated with the recovery of minerals, both oxides and sulfides, is selectivity. Some of the recognized collectors such as the carboxylic acids, alkyl sulfates and alkyl sulfonates discussed above are taught to be effective collectors for oxide mineral ores. Certainly, existing collectors are known to be useful in sulfide flotation. However, while the use of these collectors can result in acceptable recoveries, it is recognized that the selectivity to the desired mineral value may not be as high as desired and, in the case of oxide flotation, is typically quite poor. That is, the grade or the percentage of the desired mineral contained in the recovered mineral is unacceptably low.

Thus, a need remains for methods of increasing selectivity in the flotation of both sulfide and oxide ores.

SUMMARY OF THE INVENTION

The present invention is a process for the recovery of mineral values by froth flotation comprising subjecting a particulate ore, which contains silica or siliceous gangue and is in an aqueous slurry, to froth flotation under conditions such that the minerals to be recovered are floated wherein the flotation of the silica or siliceous gangue is depressed by the use of an effective amount of a hydroxy-containing compound selected from the group comprising ethanol amine, propanol amine, butanol amine, lactic acid, glycolic acid, $\beta$-hydroxy-1-propane sulfonic acid, ethylene glycol, diethylene glycol, propylene glycol, dipropylene glycol, glycerol, trihydroxy benzoic acid, hydroxy benzoic acid, butylene glycol, dibutylene glycol, diethanol amine, dipropanol amine, tripropanol amine, triethanol amine and simple sugar alcohols such as sucrose, glucose and dextrose and mixtures thereof. Additionally, the froth flotation process of this invention utilizes collectors, frothers and other flotation reagents known in the art.

By improved selectivity, it is meant that the total amount of mineral recovered and/or the grade of the mineral recovered is increased while the amount of silica or siliceous gangue not recovered, i.e. remaining in the aqueous phase, is also increased. Thus, by the process of this invention, the ability to separate silica and/or siliceous gangue from desirable mineral values is enhanced. That is, the tendency of the silica or siliceous gangue to float is depressed.

The flotation process of this invention is useful in the recovery of various minerals, including oxide minerals, by froth flotation.

DETAILED DESCRIPTION OF ILLUSTRATIVE EMBODIMENTS

The flotation process of this invention is useful in the recovery of mineral values from a variety of ores. An ore herein refers to the mineral as it is taken out of the ground and includes the mineral-containing species intermixed with gangue. Gangue are those materials which are of little or no value and need to be separated from the mineral values. In this invention, gangue specifically includes silica and siliceous materials.

As is well recognized by one skilled in the art, different types of collectors are effective with different types of ores. Certain anionic collectors, described below and useful in the present invention, have been found to be surprisingly effective in the flotation of oxide ores. The oxide minerals which may be treated by the practice of this invention include carbonates, sulfates and silicates as well as oxides. In addition to its effectiveness in the flotation of oxide ores, it has also been found that the anionic collectors in the flotation process of this invention are also effective in the flotation of sulfide ores and mixed oxide/sulfide ores.

Non-limiting examples of oxide ores which may be floated using the practice of this invention preferably include iron oxides, nickel oxides, phosphorus oxides, copper oxides and titanium oxides. Other types of oxygen-containing minerals which may be floated using the practice of this invention include carbonates such as calcite or dolomite and hydroxides such as bauxite.

The process of this invention using the anionic collectors described below is also useful in the flotation of various sulfide ores. Non-limiting examples of sulfide ores which may be floated by the process of this invention include those containing chalcopyrite, chalcocite, galena, pyrite, sphalerite and pentlandite.

Noble metals such as gold and silver and the platinum group metals wherein platinum group metals comprise platinum, ruthenium, rhodium, palladium, osmium, and iridium, may also be recovered by the practice of this invention. For example, such metals are sometimes found associated with oxide and/or sulfide ores. For example, platinum is sometimes found associated with troilite. By the practice of the present invention, such metals may be recovered in good yield.

Non-limiting examples of oxide ores which may be subjected to froth flotation using the process of this invention are those including cassiterite, hematite, cuprite, vallerite, calcite, talc, kaolin, apatite, dolomite, bauxite, spinel, corundum, laterite, azurite, rutile, magnetite, columbite, ilmenite, smithsonite, anglesite, scheelite, chromite, cerussite, pyrolusite, malachite, chrysocolla, zincite, massicot, bixbyite, anatase, brookite, tungstite, uraninite, gummite, brucite, manganite, psilomelane, goethite, limonite, chrysoberyl, microlite, tantalite and samarskite. One skilled in the art will recognize that the froth flotation process of this invention will be useful for the processing of additional ores including oxide ores wherein oxide is defined to include carbonates, hydroxides, sulfates and silicates as well as oxides and sulfide ores.

Ores for which the process of this invention using anionic thiol collectors are useful include sulfide mineral ores containing copper, zinc, molybdenum, cobalt, nickel, lead, arsenic, silver, chromium, gold, platinum, uranium and mixtures thereof. Examples of metal-containing sulfide minerals which may be concentrated by froth flotation using the composition and process of this invention include copper-bearing minerals such as covellite ($CuS$), chalcocite ($Cu_2S$), chalcopyrite ($CuFeS_2$), bornite ($Cu_5FeS_4$), vallerite ($Cu_2Fe_4S_7$ or $Cu_3Fe_4S_7$), tetrahedrite ($Cu_3SbS_2$), enargite ($Cu_3(As_2Sb)S_4$), tennantite ($Cu_{12}As_4S_{13}$), cubanite ($Cu_2SFe_4S_5$), brochantite ($Cu_4(OH)_6SO_4$), antlerite ($Cu_3SO_4(OH)_4$), famatinite ($Cu_3(SbAs)S_4$), and bournonite ($PbCuSbS_3$): lead-bearing minerals such as galena ($PbS$): antimony-bearing minerals such as stibnite ($Sb_2S_3$) zinc-bearing minerals such as sphalerite ($ZnS$); silver-bearing minerals such as stephanite ($Ag_5SbS_4$) and argentite ($Ag_2S$): chromium-bearing minerals such as daubreelite ($FeSCrS_3$): nickel-bearing minerals such as pentlandite [$(FeNi)_9S_8$]; molybdenum-bearing minerals such as molybdenite ($MoS_2$); and platinum- and palladium-bearing minerals such as cooperite [$Pt(AsS)_2$]. Preferred metal-containing sulfide minerals include molybdenite ($MoS_2$), chalcopyrite ($CuFeS_2$), chalcocite ($Cu_2S$), galena ($PbS$), sphalerite ($ZnS$), bornite ($Cu_5FeS_4$), and pentlandite [$(FeNi)_9S_8$].

Sulfidized metal-containing oxide minerals are minerals which are treated with a sulfidization chemical, so as to give such minerals sulfide mineral characteristics. The minerals so treated can then be recovered in froth flotation using collectors which recover sulfide minerals. Sulfidization results in oxide minerals having sulfide mineral characteristics. Oxide minerals are sulfidized by contact with compounds which react with the minerals to form a sulfur bond or affinity. Such methods are well known in the art. Such compounds include sodium hydrosulfide, sulfuric acid and related sulfur-containing salts such as sodium sulfide.

Sulfidized metal-containing oxide minerals and oxide minerals for which this process utilizing the thiol collectors described below is useful include oxide minerals containing copper, aluminum, iron, titanium, magnesium, chromium, tungsten, molybdenum, manganese, tin, uranium, and mixtures thereof. Examples of metal-containing minerals which may be sulfidized by froth flotation using the thiol collectors described below include copper-bearing minerals such as malachite ($Cu_2(OH)_2CO_3$), azurite ($Cu_3(OH)_2(CO_3)_2$), cuprite ($Cu_2O$), atacamite ($Cu_2Cl(OH)_3$), tenorite ($CuO$), chrysocolla ($CuSiO_3$) aluminum-bearing minerals such as corundum; zinc-containing minerals such as zincite ($ZnO$) and smithsonite ($ZnCO_3$): tungsten-bearing minerals such as wolframite [$(Fe_2Mn)WO_4$]; nickel-bearing minerals such as bunsenite ($NiO$): molybdenum-bearing minerals such as wulfenite ($PbMoO_4$) and powellite ($CaMoO_4$); iron-containing minerals such as hematite and magnetite: chromium-containing minerals such as chromite $FeOCr_2O_3$): iron- and titanium-containing minerals such as ilmenite: magnesium- and aluminum-containing minerals such as spinel: titanium-containing minerals such as rutile: manganese-containing minerals such as pyrolusite: tin-containing ores: minerals such as cassiterite: and uranium-containing minerals such as uraninite, pitchblende ($U_2O_5(U_3O_8)$) and gummite ($UO_3nH_2O$).

Other metal-containing minerals for which the use of thiol collectors in this process is useful include gold-bearing minerals such as sylvanite ($AuAgTe_2$) and calaverite ($AuTe$); platinum- and palladium-bearing minerals such as sperrylite ($PtAs_2$): and silver-bearing minerals such as hessite ($AgTe_2$). Also included are metals which occur in a metallic state, e.g., gold, silver and copper.

In a preferred embodiment of this invention, copper-containing sulfide minerals, nickel-containing sulfide minerals, lead-containing sulfide minerals, zinc-containing sulfide minerals or molybdenum-containing sulfide minerals are recovered. In an even more preferred embodiment, a copper-containing sulfide mineral is recovered.

Ores do not always exist purely as oxide ores or as sulfide ores. Ores occurring in nature may comprise both sulfur-oontaining and oxygen-containing minerals as well as, in some cases, noble metals. Metals may be recovered from the oxides found in such ores by the practice of this invention. This may be done in a two-stage flotation where one stage comprises conventional sulfide flotation to recover primarily sulfide minerals and the other stage of the flotation utilizes the process of the present invention using the anionic collectors described below to recover primarily the oxide minerals. Alternatively, the various types of minerals may be recovered simultaneously by the practice of this invention.

In addition to the flotation of ores found in nature, the flotation process of this invention is useful in the flotation of oxides and sulfides from other sources. For example, the waste materials from various processes such as heavy media separation, magnetic separation, metal working and petroleum processing often contain oxides and/or sulfides that may be recovered using the flotation process of the present invention.

A wide variety of anionic collectors are useful in the practice of the present invention. The anionic portion of the anionic collector is preferably derived from carboxylic, sulfonic, sulfuric, phosphoric or phosphonic acids. The anionic collector is also hydrophobic. Its hydrophobicity is derived from a saturated or unsaturated hydrocarbyl or saturated or unsaturated substituted hydrocarbyl moiety. Examples of suitable hydrocarbyl moieties include straight or branched alkyl, arylalkyl and alkylaryl groups. Non-limiting examples of substituents for the hydrocarbyl group include alkoxy, ether, amino, hydroxy and carboxy. When the hydrocarbyl moiety is unsaturated, it is preferably ethylenically unsaturated. It should also be recognized that the anionic surfactant may be a mixture of compounds.

The anionic collector may be used in acid form or in salt form, depending on which is soluble under conditions of use. The appropriate form of the anionic collector will vary depending on the particular collector used and other conditions present in the flotation process. One skilled in the art will recognize that some of the anionic collectors useful in the present invention will be soluble in the acid form under conditions of use while others will be soluble in the salt form. For example, oleic acid is preferably used in the acid form and saturated carboxylic acids are preferably used in salt form. When the anionic collectors of the present invention are used in salt form, the counter ion may be a calcium ion, a magnesium ion, a sodium ion, a potassium ion or an ammonium ion. As discussed above, the choice of an appropriate counter ion depends on the particular anionic collector used and its solubility. It is generally preferred that the counter ion be a sodium ion, a potassium ion or an ammonium ion.

Non-limiting examples of suitable anionic collectors include linolenic acid, oleic acid, lauric acid, linoleic acid, octanoic acid, capric acid, myristic acid, palmitic acid, stearic acid, araohidic acid, behenic acid, 2-naphthalene sulfonic acid, sodium lauryl sulfate, sodium stearate, dodecane sodium sulfonic acid, hexadecyl sulfonic acid, dodecyl sodium sulfate, dodecyl phosphate, chloride derivative of dodecyl phosphonic acid, 2-naphthoic acid, pimelic acid, and dodecyl benzene sulfonate and mixtures thereof.

Preferred anionic collectors include those derived from oarboxylic acids and sulfonic acids. In the case of the anionic surfactants derived from carboxylic acids, the unsaturated acids such as oleic acid, linoleic acid and linolenic acids or mixtures thereof are preferred. Examples of mixtures of these carboxylic acids include tall oil and coconut oil.

When the anionic collector is derived from sulfonic acids, it is preferred to use alkyl or alkylaryl sulfonic acids. Examples of preferred species include dodecyl benzene sulfonic acid, dodecyl sulfonic acid, alkylated diphenyl oxide monosulfonic acid and salts thereof.

The thiol collectors of this invention are compounds selected from the group consisting of thiocarbonates, thionocarbamates, thiocarbanilides, thiophosphates, thiophosphinates, mercaptans, xanthogen formates, xanthic esters and mixtures thereof.

Preferred thiocarbonates are the alkyl thiocarbonates represented by the structural formula

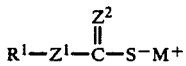

wherein each $R^1$ is independently a $C_{1-20}$, preferably $C_{2-16}$, more preferably $C_{3-12}$ alkyl group:

$Z^1$ and $Z^2$ are independently a sulfur or oxygen atom; and $M+$ is an alkali metal cation.

The compounds represented by this formula include the alkyl thiocarbonates (both $Z^1$ and $Z^2$ are oxygen), alkyl dithiocarbonates ($Z^1$ is O, $Z^2$ is S) and the alkyl trithiocarbonates (both $Z^1$ and $Z^2$ are sulfur).

Examples of preferred alkyl monothiocarbonates include sodium ethyl monothiocarbonate, sodium isopropyl monothiocarbonate, sodium isobutyl monothiocarbonate, sodium amyl monothiocarbonate, potassium ethyl monothiocarbonate, potassium isopropyl monothiocarbonate, potassium isobutyl monothiocarbonate and potassium amyl monothiocarbonate. Preferred alkyl dithiocarbonates include potassium ethyl dithiocarbonate, sodium ethyl dithiocarbonate, potassium amyl dithiocarbonate, sodium amyl dithiocarbonate, potassium isopropyl dithiocarbonate, sodium isopropyl dithiocarbonate. sodium sec-butyl dithiocarbonate, potassium sec-butyl dithiocarbonate, sodium isobutyl dithiocarbonate, potassium isobutyl dithiocarbonate, and the like. Examples of alkyl trithiocarbonates include sodium isobutyl trithiocarbonate and potassium isobutyl trithiocarbonate. It is often preferred to employ a mixture of an alkyl monothiocarbonate, alkyl dithiocarbonate and alkyl trithiocarbonate.

Preferred thionocarbamates correspond to the formula

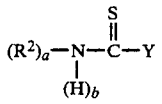

wherein each $R^2$ is independently a $C_{1-10}$, preferably a $C_{1-4}$, more preferably a $C_{1-3}$, alkyl group:

Y is $—S^-M^+$ or $—OR^3$, wherein $R^3$ is a $C_{1-10}$, preferably a $C_{2-6}$, more preferably a $C_{3-4}$, alkyl group:

a is the integer 1 or 2: and b is the integer 0 or 1, wherein a+b must equal 2.

Preferred thionocarbamates include dialkyl dithiocarbamates (a=2, b=0 and Y is $S^-M^+$) and alkyl thionocarbamates (a=1, b=1 and Y is $—OR^3$). Examples of preferred dialkyl dithiocarbamates include methyl butyl dithiocarbamate, methyl isobutyl dithiocarbamate, methyl sec-butyl dithiocarbamate, methyl propyl dithiocarbamate, methyl isopropyl dithiocarbamate, ethyl butyl dithiocarbamate, ethyl isobutyl dithiocarbamate, ethyl sec-butyl dithiocarbamate, ethyl propyl dithiocarbamate, and ethyl isopropyl dithiocarbamate. Examples of preferred alkyl thionocarbamates include N-methyl butyl thionocarbamate, N-methyl isobutyl thionocarbamate, N-methyl sec-butyl thionocarbamate, N-methyl propyl thionocarbamate, N-methyl isopropyl thionocarbamate, N-ethyl butyl thionocarbamate, N-ethyl isobutyl thionocarbamate, N-ethyl sec-butyl thionocarbamate, N-ethyl propyl thionocarbamate, and N-ethyl isopropyl thionocarbamate. Of the foregoing, N-ethyl isopropyl thionocarbamate and N-ethyl isobutyl thionocarbamate are most preferred.

Thiophosphates useful herein generally correspond to the formula

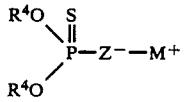

wherein each $R^4$ is independently hydrogen or a $C_{1-10}$ alkyl, preferably a $C_{2-8}$ alkyl, or an aryl, preferably an aryl group having from 6–10 carbon atoms, more preferably cresyl: Z is oxygen or sulfur: and M is an alkali metal cation.

Of the thiophosphates, those preferably employed include the monoalkyl dithiophosphates (one $R^4$ is hydrogen and the other $R^4$ is a $C_{1-10}$ alkyl and Z is S), dialkyl dithiophosphates (both $R^4$ are $C_{1-10}$ alkyl and Z is S) and dialkyl monothiophosphate (both $R^4$ are a $C_{1-10}$ alkyl and Z is O).

Examples of preferred monoalkyl dithiophosphates include ethyl dithiophosphate, propyl dithiophosphate, isopropyl dithiophosphate, butyl dithiophosphate, sec-butyl dithiophosphate, and isobutyl dithiophosphate. Examples of dialkyl or aryl dithiophosphates include sodium diethyl dithiophosphate, sodium di-sec-butyl dithiophosphate, sodium diisobutyl dithiophosphate, and sodium diisoamyl dithiophosphate. Preferred monothiophosphates include sodium diethyl monothiophosphate, sodium di-sec-butyl monothiophosphate, sodium diisobutyl monothiophosphate, and sodium diisoamyl monothiophosphate.

Thiocarbanilides (dialkyl thioureas) are represented by the general structural formula:

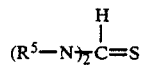

wherein each $R^5$ is individually H or a $C_{1-6}$, preferably a $C_{1-3}$, hydrocarbyl.

Thiophosphinates are represented by the general structural formula:

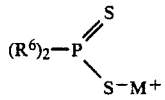

wherein $M^+$ is as hereinbefore described and each $R^6$ is independently an alkyl or aryl group, preferably an alkyl group having from 1 to 12, more preferably an alkyl group having from 1 to 8 carbon atoms. Most preferably, each $R^6$ is isobutyl.

Mercaptan oollectors are preferably alkyl mercaptans represented by the general structural formula:

$R^7—S—H$ wherein $R^7$ is an alkyl group, preferably an alkyl group having at least 10, more preferably from 10 to 16, carbon atoms.

Xanthogen formates are represented by the general structural formula:

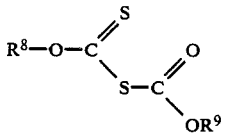

wherein $R^8$ is an alkyl group having from 1 to 7, preferably from 2 to 6 carbon atoms and $R^9$ is an alkyl group having 1 to 6, preferably 2 to 4, more preferably 2 or 3, carbon atoms.

Xanthic esters are preferably compounds of the general structural formula:

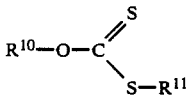

$R^{10}$ is an allyl group and $R^{11}$ is an alkyl group having from 1 to 7 carbon atoms.

Preferred thiol compounds for use as a collector are the thiocarbonates, thionocarbamates and the thiophosphates due to the surprisingly high recoveries and selectivities towards mineral values which can be achieved.

As will be recognized by one skilled in the art, the thiol collectors described above are particularly useful in the flotation of sulfide minerals or sulfidized oxide minerals. The other anionic collectors described above are useful in the flotation of certain sulfide minerals, but are also surprisingly useful in the flotation of oxide minerals.

The hydroxy-containing compound useful in the practice of this invention comprises compounds containing at least one —OH moiety. This hydroxy compound is selected to be essentially non-frothing under the conditions of use. For purposes of this invention, non-frothing compounds are those which have minimal frothing action under the conditions of use. As is well recognized by those skilled in the art, when considering simple hydroxy-containing compounds such as alcohols, their frother power generally increases with the number of carbon atoms in the alcohol up to about six or seven. When the number of carbon atoms reaches this point, the effectiveness of the alcohol as a frother drops. Thus, under some conditions of use, monohydric alcohols such as octanol, nonanol, decanol, undecanol and dodecanol may be useful as non-frothing hydroxy-containing compounds. Laboratory scale flotation work using relatively pure water has shown that these alcohols may be non-frothing and useful in the practice of this invention. However, under most practical conditions of use, these alcohols demonstrate sufficient frothing so that their use is not preferred.

In a preferred embodiment, the hydroxy-containing compound useful in the collector composition of the present invention corresponds to the formula:

$$R_n(X)_a$$

wherein X is —O—, $—NH_2$, —NH—, or $$-\underset{|}{N}-,$$

a is 0 or 1, R is a $C_{2-12}$ organic moiety having from 1 to about 12 hydroxy substituents and n is 1 to 3. R may be a linear, branched or cyclic alkyl group or an aromatic group with linear alkyl being preferred. When R is cyclic, the hydroxy-containing compound is preferably a simple sugar alcohol and when R is aromatic, it is preferably a hydroxy-substituted benzoic acid. When a is 0, R must contain at least two substituents, one of which is hydroxy. The additional substituent(s) may be hydroxy. Examples of other useful substituents include $—SO_3H$, —COOH or a phosphonate group. When a is 1, R may contain substituents in addition to the hydroxy moieties so long as they do not impart frothing properties to the compound. It is preferred that a is 1 and that R is an $C_{2-3}$ alkyl group containing no substituents in addition to the hydroxy moiety.

Non-limiting examples of hydroxy-containing compounds useful in the practice of this invention include ethanol amine, propanol amine, butanol amine, lactic acid, glycolic acid, β-hydroxy-1-propane sulfonic acid, ethylene glycol, diethylene glycol, propylene glycol, dipropylene glycol, glycerol, trihydroxy benzoic acid, hydroxy benzoic acid, butylene glycol, dibutylene glycol, diethanol amine, dipropanol amine, tripropanol amine, triethanol amine and simple sugar alcohols such as sucrose, glucose and dextrose.

In a more preferred embodiment, the hydroxy-containing compound is an alkanol amine, even more preferably a lower alkanol amine. Non-limiting examples of lower alkanol amines useful in the practice of this invention include ethanol amine, propanol amine, butanol amine, diethanol amine, dipropanol amine, tripropanol amine, triethanol amine and mixtures thereof.

The alkanol amines useful in the practice of this invention are available commercially. As will be recognized by one skilled in the art, commercially available alkanol amines will have varying degrees of purity. For example, diethanol amine may contain varying amounts of ethanol amine and/or triethanol amine. Such alkanol amines are suitable in the practice of the present invention.

The hydroxy-containing compounds may be added directly to the float cell or may be added to the grinding stage. The preferred time of addition will vary depending on the particular ore being floated, the other reagents present and the processing system being used. The hydroxy-containing compounds are not premixed with the collector prior to addition to the flotation process. They are preferably added to the flotation system separately from the collector. They are also preferably added prior to the addition of the collector. For example, the hydroxy-containing compounds may be added to the grinding stage.

The collector can be used in any concentration which gives the desired recovery of the desired metal values. In particular, the concentration used is dependent upon the particular mineral to be recovered, the grade of the ore to be subjected to the froth flotation process and the desired quality of the mineral to be recovered. Additional factors to be considered in determining dosage levels include the amount of surface area of the ore to be treated. As will be recognized by one skilled in the art, the smaller the particle size, the greater the amount of collector reagents needed to obtain adequate recoveries and grades.

Preferably, the concentration of the collector is at least about 0.001 kg/metric ton, more preferably at least about 0.005 kg/metric ton. It is also preferred that the total concentration of the collector is no greater than about 5.0 kg/metric ton and more preferred that it is no greater than about 2.5 kg/metric ton. It is more preferred that the concentration of the collector is at least about 0.005 kg/metric ton and no greater than about 0.100 kg/metric ton. It is generally preferred to start at the lower concentration range and gradually increase the concentration to obtain optimum performance.

The concentration of the hydroxy-containing compounds useful in this invention is preferably at least about 0.001 kg/metric ton and no greater than about 5.0 kg/metric ton. A more preferred concentration is at least about 0.005 kg/metric ton and no more than about 0.500 kg/metric ton. As discussed above, it is generally preferred to start at the lower concentration range and gradually increase the concentration to obtain optimum performance. This is particularly important when thiol collectors are used in the flotation of sulfide minerals since the general trend is that selectivity is increased at the expense of overall recovery.

It has been found advantageous in the recovery of certain minerals to add the collector to the flotation system in stages. By staged addition, it is meant that a part of the total collector dose is added; froth concentrate is collected: an additional portion of the collector is added; and froth concentrate is again collected. This staged addition can be repeated several times to obtain optimum recovery and grade. The number of stages in which the collector is added is limited only by practical and economic constraints. Preferably, no more than about six stages are used.

In addition to the collectors and hydroxy-containing compounds of this invention, other conventional additives may be used in the flotation process, including other collectors. Examples of such additives include depressants and dispersants. In addition to these additives, frothers may be and preferably are also used. Frothers are well-known in the art and reference thereto is made for the purposes of this invention. Non-limiting examples of useful frothers include $C_{5-8}$ alcohols, pine oils, cresols, $C_{1-6}$ alkyl ethers of polypropylene glycols, dihydroxylates of polypropylene glycols, glycol fatty acids, soaps, alkylaryl sulfonates and mixtures thereof.

When the anionic collectors of this invention are used, pH is theorized to play a role in the flotation process. The nature of the anionic collectors of the present invention is related to the charge charaoteristics of the particular oxide mineral to be recovered. Thus, pH plays an important role in the froth flotation process of the present invention. While not wishing to be bound by any particular theory, it is assumed that the anionic collector attaches to the oxide at least in part through charge interaction with the mineral surface. Thus, pH conditions under which the charge of the oxide mineral is suitable for attachment are required in the practice of this invention.

The pH in flotation systems may be controlled by various methods known to one skilled in the art. A common reagent used to control pH is lime. However, in the practice of this invention, it is preferred to use reagents suoh as potassium hydroxide, sodium hydroxide and sodium carbonate and other reagents having monovalent cations to regulate pH. Reagents having divalent cations such as magnesium hydroxide and calcium hydroxide may be used, but are not preferred since their use results in the need to use larger dosages of the collector. It should be noted that when the anionic collector is derived from sulfonic and sulfuric acids, the presence of divalent and/or metal cations is not as detrimental.

The following examples are provided to illustrate the invention and should not be interpreted as limiting it in any way. Unless stated otherwise, all parts and percentages are by weight.

The following examples include work involving Hallimond tube flotation and flotation done in laboratory scale flotation cells. It should be noted that Hallimond tube flotation is a simple way to screen collectors, but does not necessarily predict the success of collectors in actual flotation. Hallimond tube flotation does not involve the shear or agitation present in actual flotation and does not measure the effect of frothers. Thus, while a collector must be effective in a Hallimond tube flotation if it is to be effective in actual flotation, a collector effective in Hallimond tube flotation will not necessarily be effective in actual flotation. It should also be noted that experience has shown that collector dosages required to obtain satisfactory recoveries in a Hallimond tube are often substantially higher than those required in a flotation cell test. Thus, the Hallimond tube work cannot precisely predict dosages that would be required in an actual flotation cell.

EXAMPLE 1

Hallimond Tube Flotation of Malachite and Silica

In this example, the effect of various collectors on the flotation of copper is determined using a Hallimond tube. About 1.1 g of (1) malachite, a copper oxide mineral having the approximate formula $Cu_2CO_3(OH)_2$, or (2) silica is sized to about −60 to +120 U.S. mesh and placed in a small bottle with about 20 ml of deionized water. The mixture is shaken 30 seconds and then the water phase containing some suspended fine solids or slimes is decanted. This desliming step is repeated several times.

A 150-ml portion of deionized water is placed in a 250-ml glass beaker. Next, 2.0 ml of a 0.10 molar solution of potassium nitrate is added as a buffer electrolyte. The pH is adjusted to about 10.0 with the addition of 0.10 N HCl and/or 0.10 N NaOH. Next, a 1.0-g portion of the deslimed mineral is added along with deionized water to bring the total volume to about 180 ml. The collector and hydroxy-containing compound, as identified in the various runs reported in Table I below, are added and allowed to condition with stirring for 15 minutes. The pH is monitored and adjusted as necessary.

The slurry is transferred into a Hallimond tube designed to allow a hollow needle to be fitted at the base of the 180-ml tube. After the addition of the slurry to the Hallimond tube, a vacuum of 5 inches of mercury is applied to the opening of the tube for a period of 10 minutes. This vacuum allows air bubbles to enter the tube through the hollow needle inserted at the base of the tube. During flotation, the slurry is agitated with a magnetic stirrer set at 200 revolutions per minute (RPM).

The floated and unfloated material is filtered out of the slurry and oven dried at 100° C. Each portion is weighed. After each test, all equipment is washed with concentrated HCl and rinsed with 0.10 N NaOH and deionized water before the next run.

The results obtained using the above-described procedure and varying the identity of the collector and hydroxy-containing compound are reported in Table I below. The recovery of malachite and silica, respectively, reported is that fractional portion of the original mineral placed in the Hallimond tube that is recovered. Thus, a recovery of 1.00 indicates that all of the material is recovered. It should be noted that although the recovery of copper and silica, respectively, is reported for eaoh run, the data is actually collected in two separate experiments done under identical conditions. It should further be noted that a low silica recovery suggests a selectivity to the copper. The values given for copper recovery generally are correct to ±0.05 and those for silica recovery are generally correct to ±0.03.

TABLE I

| Run | Collector | Dosage (kg/kg) | Fractional Cu Recovery | Fractional Silica Recovery |
|---|---|---|---|---|
| 1① | Oleic acid | 0.024 | 0.860 | 0.096 |
| 2① | Lauric acid | 0.024 | 0.786 | 0.154 |
| 3① | Octanoic acid | 0.024 | 0.228 | 0.354 |
| 4① | Linoleic acid | 0.024 | 0.982 | 0.120 |
| 5① | 2-naphthalene sulfonic acid | 0.024 | 0.073 | 0.000 |
| 6① | Sodium lauryl sulfate | 0.024 | 0.971 | 0.106 |
| 7① | Dodecyl sodium sulfonate | 0.024 | 0.223 | 0.212 |
| 8① | Dodecyl phosphonic acid | 0.024 | 0.910 | 0.071 |
| 9① | 1,2-dodecanediol | 0.024 | 0.255 | 0.210 |
| 10 | 1,2-dodecanediol | 0.012 | 0.938 | 0.154 |
| | Oleic acid | 0.012 | | |
| 11① | Benzoic acid | 0.024 | 0.058 | 0.000 |
| 12 | Benzoic acid | 0.012 | 0.592 | 0.071 |
| | Oleic acid | 0.012 | | |
| 13① | Hydroxy benzoic acid | 0.024 | 0.072 | 0.246 |
| 14 | Hydroxy benzoic acid | 0.012 | 0.732 | 0.191 |
| | Oleic acid | 0.012 | | |
| 15① | Trihydroxy benzoic acid | 0.024 | 0.068 | 0.113 |
| 16 | Trihydroxy benzoic | 0.012 | 0.816 | 0.089 |

TABLE I-continued

| Run | Collector | Dosage (kg/kg) | Fractional Cu Recovery | Fractional Silica Recovery |
|---|---|---|---|---|
| | acid | | | |
| | Oleic acid | 0.012 | | |
| 17① | Phenol | 0.024 | 0.059 | 0.137 |
| 18 | Phenol | 0.012 | 0.389 | 0.099 |
| | Oleic acid | 0.012 | | |
| 19① | Potassium salt of dodecyl xanthate | 0.024 | 0.962 | 0.137 |
| 20① | $C_6H_9(CH_2)_2OCS_2K$ | 0.024 | 0.170 | 0.165 |
| 21① | Linolenic acid | 0.024 | 0.973 | 0.243 |
| 22① | Stearic acid | 0.024 | 1.000 | 0.122 |
| 23① | Palmitic acid | 0.024 | 1.000 | 0.082 |
| 24① | Glycerol | 0.024 | 0.038 | 0.380 |
| 25 | Glycerol | 0.012 | 0.748 | 0.283 |
| | Oleic acid | 0.012 | | |
| 26① | Ethanol amine | 0.024 | 0.435 | 0.261 |
| 27 | Ethanol amine | 0.012 | 0.963 | 0.105 |
| | Oleic acid | 0.012 | | |
| 28① | 2-propanol amine | 0.024 | 0.541 | 0.294 |
| 29 | 2-propanol amine | 0.012 | 0.993 | 0.117 |
| | Oleic acid | 0.012 | | |
| 30① | Glycolic acid | 0.024 | 0.116 | 0.049 |
| 31 | Glycolic acid | 0.012 | 0.904 | 0.047 |
| | Oleic acid | 0.012 | | |
| 32① | β-hydroxy propionic acid | 0.024 | 0.247 | 0.061 |
| 33 | β-hydroxy propionic acid | 0.012 | 0.933 | 0.060 |
| | Oleic acid | 0.012 | | |
| 34① | Lactic acid | 0.024 | 0.094 | 0.035 |
| 35 | Lactic acid | 0.012 | 0.893 | 0.031 |
| | Oleic acid | 0.012 | | |
| 36① | 3-hydroxy-1-propane sulfonic acid | 0.024 | 0.513 | 0.119 |
| 37 | 3-hydroxy-1-propane sulfonic acid | 0.012 | 0.971 | 0.090 |
| | Oleic acid | 0.012 | | |
| 38① | Propylene glycol | 0.024 | 0.344 | 0.149 |
| 39 | Propylene glycol | 0.012 | 0.967 | 0.077 |
| | Oleic acid | | | |
| 40 | Propylene glycol | 0.012 | 0.917 | 0.051 |
| | Lauric acid | 0.012 | | |
| 41 | Propylene glycol | 0.012 | 0.855 | 0.099 |
| | Octanoic acid | 0.012 | | |
| 42 | Propylene glycol | 0.012 | 0.979 | 0.019 |
| | Linoleic acid | 0.012 | | |
| 43 | Propylene glycol | 0.012 | 0.391 | 0.020 |
| | 2-naphthalene sulfonic acid | 0.012 | | |
| 44 | Propylene glycol | 0.012 | 0.994 | 0.068 |
| | Sodium lauryl sulfate | 0.012 | | |
| 45 | Propylene glycol | 0.012 | 0.844 | 0.092 |
| | Dodecyl sodium sulfonate | 0.012 | | |
| 46 | Propylene glycol | 0.012 | 0.998 | 0.088 |
| | Potassium salt of dodecyl xanthate | 0.012 | | |
| 47 | Propylene glycol | 0.012 | 0.773 | 0.061 |
| | $C_6H_9(CH_2)_2OCS_2K$ | 0.012 | | |
| 48 | Propylene glycol | 0.012 | 1.000 | 0.067 |
| | Linolenic acid | 0.012 | | |
| 49 | Propylene glycol | 0.012 | 1.000 | 0.099 |
| | Stearic acid | 0.012 | | |
| 50 | Propylene glycol | 0.012 | 1.000 | 0.049 |
| | Palmitic acid | 0.012 | | |
| 51 | Propylene glycol | 0.012 | 0.818 | 0.043 |
| | Dodecyl benzene sulfonic acid | 0.012 | | |
| 52① | Diethanol amine | 0.024 | 0.389 | 0.147 |
| 53 | Diethanol amine | 0.012 | 1.000 | 0.071 |
| | Oleic acid | 0.012 | | |
| 54 | Diethanol amine | 0.012 | 0.991 | 0.023 |
| | Linoleic acid | 0.012 | | |
| 55 | Diethanol amine | 0.012 | 0.791 | 0.097 |
| | Dodecyl sodium sulfonate | 0.012 | | |
| 56 | Diethanol amine | 0.012 | 0.801 | 0.047 |
| | Dodecyl benzene sulfonic acid | 0.012 | | |
| 57① | Amino decanol | 0.024 | 0.197 | 0.071 |
| 58 | Amino decanol | 0.012 | 0.731 | 0.047 |

TABLE I-continued

| Run | Collector | Dosage (kg/kg) | Fractional Cu Recovery | Fractional Silica Recovery |
|---|---|---|---|---|
| | Oleic acid | 0.012 | | |

①Not an embodiment of the invention.

The data in the table above indicates the broad effectiveness of the present invention in a Hallimond tube. It also indicates that the hydroxy-containing compound alone generally functions poorly as a collector.

EXAMPLE 2

Hallimond Tube Flotation of Chrysocolla and Silica

The procedure outlined for Example 1 is followed with the exception that chrysocolla ($Cu_2H_2Si_2O_5(OH)_4$) is used in place of malachite. In addition, in some cases different collectors and hydroxy-containing compounds are used. The results obtained are set out in Table II below.

TABLE II

| Run | Collector | Dosage (kg/kg) | Fractional Cu Recovery | Fractional Silica Recovery |
|---|---|---|---|---|
| 1① | Oleic acid | 0.024 | 0.950 | 0.137 |
| 2① | Dodecyl benzene sulfonic acid | 0.024 | 0.363 | 0.163 |
| 3① | Propylene glycol | 0.024 | 0.227 | 0.146 |
| 4① | Diethanol amine | 0.024 | 0.191 | 0.151 |
| 5 | Propylene glycol | 0.012 | 0.999 | 0.094 |
| | Oleic acid | | | |
| 6 | Propylene glycol | 0.012 | 0.844 | 0.101 |
| | Dodecyl benzene sulfonic acid | 0.012 | | |
| 7 | Diethanol amine | 0.012 | 0.986 | 0.096 |
| | Oleic acid | 0.012 | | |
| 8 | Diethanol amine | 0.012 | 0.773 | 0.119 |
| | Dodecyl benzene sulfonic acid | 0.012 | | |

①Not an embodiment of the invention.

The data in Table II above demonstrates the general effectiveness of the rpesent invention in the recovery of copper from chrysocolla in Hallimond tube flotation within the limitations discussed relating to Example 1. These runs demonstrate that the use of the hydroxy-containing compound and anionic surfactant results in increased copper recovery, decreased silica recovery or both when compared to identical runs using either component alone.

EXAMPLE 3

Flotation of Mixed Copper Oxide Ore

In this example, the effect of different collectors and hydroxy-containing compounds on the flotation of copper ore in laboratory flotation cells is examined. Samples of copper ore from Central Africa containing 500 g per sample are prepared. The ore contains about 76 percent by weight malachite and the remainder is made up of chrysocolla and chalcocite. A 500-g portion of the ore is ground with 257 g deionized water in a rod mill at about 60 RPM for two minutes.

The resulting pulp is next deslimed. The pulp is placed in a flotation cell. The cell is filled with water, the slurry pH is adjusted to 9.2 with sodium carbonate and then the slurry is stirred for 5 minutes. The solids in the cell are allowed to settle for 120 seconds and then the water phase containing finely divided solids is decanted. This process is repeated four times. This deslimed pulp is used in Run 8. In Runs 1–7, the desliming steps are omitted.

The pulp is transferred to a 1500-ml Agitair Flotation cell outfitted with an automatic paddle removal system. The pH of the slurry is adjusted to 9.2 by the addition of sodium carbonate, if necessary. The collectors and hydroxy-containing compounds specified in Table III are added separately to the slurry in the amounts specified in Table III and the slurry is allowed to condition for one minute after the addition of each. A polyglycol ether frother, in the amount of 40 g per ton of dry ore, is then added and the slurry is allowed to condition for one additional minute.

The flotation cell is agitated at 1150 RPM and air is introduced at a rate of 4.5 liters per minute. Samples of the froth concentrate are collected at 1.0 and 6.0-minute intervals after the air is first introduced into the cell. Samples of the tailings and concentrate are dried, weighed, and pulverized for analysis. After being pulverized, they are dissolved with the use of acid and the copper content is determined using a DC Plasma spectrometer. The assay data is used to determine fractional recoveries and grades using standard mass balance formulas.

The data obtained is shown in Table III below.

TABLE III

| Run | Collector | Dosage (kg/metric ton) | Copper Recovery and Grade 0–1 Minute Rec | 0–1 Minute Gr | 1–6 Minutes Rec | 1–6 Minutes Gr | Total Rec | Total Gr |
|---|---|---|---|---|---|---|---|---|
| 1① | NaSH | 0.5 | 0.156 | 0.091 | 0.085 | 0.048 | 0.241 | 0.076 |
| | $C_5H_{11}OCS_2K$ | 0.2 | | | | | | |
| 2① | Diethanol amine | 0.2 | — | — | — | — | 0.061 | 0.057 |
| 3 | Diethanol amine | 0.1 | 0.508 | 0.061 | 0.117 | 0.029 | 0.625 | 0.055 |
| | Oleic acid | 0.1 | | | | | | |
| 4① | Ethanol amine | 0.2 | — | — | — | — | 0.044 | 0.058 |
| 5 | Ethanol amine | 0.1 | 0.463 | 0.072 | 0.096 | 0.037 | 0.559 | 0.066 |
| | Oleic acid | 0.1 | | | | | | |
| 6① | 2-propanol amine | 0.2 | — | — | — | — | 0.056 | 0.048 |
| 7 | 2-propanol amine | 0.1 | 0.510 | 0.059 | 0.084 | 0.030 | 0.594 | 0.055 |
| | Oleic acid | 0.1 | | | | | | |
| 8① | Oleic acid | 0.2 | 0.549 | 0.058 | 0.021 | 0.009 | 0.570 | 0.056 |

①Not an embodiment of the invention.

The data in Table III above demonstrates the effectiveness of this invention under conditions approximating actual flotation conditions. Run 1, which is not an example of the invention, approximates current industry practice. Runs 3, 5, and 7, which are examples of the invention, demonstrate the effectiveness of the process of this invention in the recovery of copper.

EXAMPLE 4

Flotation of Chrysocolla Ore

A series of samples containing 500 g of ore from Central Africa are prepared. The ore contains greater than 90 percent chrysocolla and the remainder comprises additional copper oxide minerals and gangue. A 500-g sample is ground with 257 g of deionized water in a rod mill at about 60 RPM for six minutes. The resulting pulp is transferred to an Agitair 1500 ml flotation cell outfitted with an automated paddle removal system. The pH of the slurry is adjusted by the addition of either sodium carbonate or HCl. The natural ore pH in slurry form is 7.8. After addition of the hydroxy-containing compounds as shown in Table IV, the slurry is allowed to condition for one minute. The collector is then added followed by an additional minute of conditioning. A polyglycol ether frother is added in an amount of 20 g per ton of dry ore followed by an additional minute of conditioning.

The float cell is agitated at 1150 RPM and air is introduced at a rate of 4.5 liters per minute. Samples of the froth concentrate are collected at 1.0 and 6.0 minute intervals after the air is first introduced. The samples of the concentrates and the tailings are dried, weighed, pulverized for analysis and dissolved with the use of acid. The copper content is determined by the use of DC Plasma Spectrometer. Using the assay data, fractional recoveries and grades are calculated using standard mass balance formulas. The results obtained are shown in Table IV below.

TABLE IV

| Run | Collector | Dosage (kg/metric ton) | pH | Copper Recovery and Grade 0–1 Minute Rec | 0–1 Minute Gr | 1–6 Minutes Rec | 1–6 Minutes Gr | Total Rec | Total Gr |
|---|---|---|---|---|---|---|---|---|---|
| 1① | Oleic acid | 0.2 | 9.5 | 0.257 | 0.088 | 0.164 | 0.061 | 0.421 | 0.077 |
| 2① | NaSH | 0.25 | 9.5 | 0.123 | 0.050 | 0.302② | 0.072 | 0.425② | 0.065 |
| | $C_5H_{11}OCS_2K$ | 0.2 | | | | | | | |
| 3 | Diethanol amine | 0.100 | 9.5 | 0.457 | 0.141 | 0.136 | 0.067 | 0.593 | 0.124 |
| | Oleic acid | 0.100 | | | | | | | |
| 4① | Diethanol amine | 0.100 | 9.5 | — | — | — | — | 0.118 | 0.071 |
| 5 | Propylene glycol | 0.100 | 9.5 | 0.437 | 0.130 | 0.111 | 0.056 | 0.548 | 0.115 |
| | Oleic acid | 0.100 | | | | | | | |
| 6① | Propylene | 0.200 | 9.5 | — | — | — | — | 0.097 | 0.0099 |

TABLE IV-continued

| Run | Collector | Dosage (kg/metric ton) | pH | Copper Recovery and Grade 0-1 Minute Rec | 0-1 Minute Gr | 1-6 Minutes Rec | 1-6 Minutes Gr | Total Rec | Total Gr |
|---|---|---|---|---|---|---|---|---|---|
| | glycol | | | | | | | | |

①Not an embodiment of the invention.
②Flotation time is expanded to 11 minutes rather than 6 minutes. The frother dosage required is 3 times that of other runs.

The data in Table IV generally demonstrates the effectiveness of the collector composition of the present invention. Run 2 approximates current industry standards.

EXAMPLE 5

Flotation of Iron Oxide Ore

A series of 600-g samples of iron oxide ore from Michigan are prepared. The ore contains a mixture of hematite, martite, goethite and magnetite mineral species. Each 600-g sample is ground along with 400 g of deionized water in a rod mill at about 60 RPM for 10 minutes. The resulting pulp is transferred to an Agitair 3000 ml flotation cell outfitted with an automated paddle removal system. The pH of the slurry is adjusted from a natural pH of 7.3 to a pH of 8.5 using sodium carbonate. The hydroxy-containing compound, if used, is added and the slurry is allowed to condition for one minute. This is followed by the addition of the collector, followed by an additional minute of conditioning. Next, an amount of a polyglycol ether frother equivalent to 40 g per ton of dry ore is added followed by another minute of conditioning.

The float cell is agitated at 900 RPM and air is introduced at a rate of 9.0 liters per minute. Samples of the froth concentrate are collected at 1.0 and 6.0 minutes after the start of the air flow. Samples of the froth concentrate and the tailings are dried, weighed and pulverized for analysis. They are then dissolved in acid, and the iron content determined by the use of a D.C. Plasma Spectrometer. Using the assay data, the fractional recoveries and grades are calculated using standard mass balance formulas. The results are shown in Table V below.

TABLE V

| Run | Collector | Dosage (kg/metric ton) | Iron Recovery and Grade 0-1 Minute Rec | 0-1 Minute Gr | 1-6 Minutes Rec | 1-6 Minutes Gr | Total Rec | Total Gr |
|---|---|---|---|---|---|---|---|---|
| 1① | Oleic acid | 0.200 | 0.388 | 0.369 | 0.262 | 0.266 | 0.650 | 0.327 |
| 2① | Propylene glycol | 0.200 | 0.034 | 0.361 | 0.039 | 0.340 | 0.073 | 0.342 |
| 3 | Propylene glycol | 0.050 | 0.444 | 0.441 | 0.081 | 0.438 | 0.525 | 0.441 |
| | Oleic acid | 0.050 | | | | | | |
| 4① | Oleic acid | 0.100 | 0.165 | 0.313 | 0.145 | 0.287 | 0.310 | 0.301 |
| 5 | Propylene glycol | 0.100 | 0.587 | 0.421 | 0.055 | 0.358 | 0.642 | 0.416 |
| | Oleic acid | 0.100 | | | | | | |
| 6 | Diethylene glycol | 0.100 | 0.484 | 0.460 | 0.075 | 0.428 | 0.559 | 0.456 |
| | Oleic acid | 0.100 | | | | | | |
| 7 | Diethanol amine | 0.100 | 0.421 | 0.471 | 0.072 | 0.457 | 0.493 | 0.469 |
| | Oleic acid | 0.100 | | | | | | |
| 8① | Diethanol amine | 0.200 | — | — | — | — | 0.141 | 0.458② |
| 9① | Ethanol amine | 0.200 | — | — | — | — | 0.074 | 0.376② |
| 10 | Ethanol amine | 0.100 | 0.298 | 0.357 | 0.089 | 0.396 | 0.387 | 0.366 |
| | Oleic acid | 0.100 | | | | | | |

①Not an embodiment of the invention.
②Only one concentrate sample collected.

The data in Table V above demonstrates the effectiveness of the present invention in obtaining good recoveries of high grade iron.

EXAMPLE

Flotation of Arizona Copper Oxide Ore

A series of 30-g samples of −60 mesh copper ore from Arizona are prepared. It should be noted that this ore is very fine and, thus, very difficult to float. The make-up of the valuable components of the ore is about 60 percent azurite $Cu_3(CO_3)(OH)_2$], 35 percent malachite [$Cu_2CO_3(OH)_2$], and 5 percent chalcocite [$Cu_2S$]. Each sample of ore is ground with 15 g of deionized water in a rod mill (2.5 inch diameter with 0.5 inch rods) for 240 revolutions. The resulting pulp is transferred to a 300 ml flotation cell.

The pH of the slurry is left at natural ore pH of 8.0 unless otherwise noted. After addition of the hydroxy-containing compound as shown in Table VI, the slurry is allowed to condition for one minute. Next, the collector is added with an additional minute of conditioning. Next, the frother, a polyglycol ether, is added in an amount equivalent to 0.050 g per ton of dry ore and the slurry is allowed to condition an additional minute.

The float cell is agitated at 1800 RPM and air is introduced at a rate of 2.7 liters per minute. Samples of the froth concentrate are collected by standard hand paddling at 1.0 and 6.0 minutes after the start of the introduction of air into the cell. Samples of the concentrate and the tailings are dried and analyzed as described in the previous examples. The results obtained are presented in Table VI below.

TABLE VI

| Run | Collector | Dosage (kg/metric ton) | Copper Recovery and Grade 0–1 Minute Rec | 0–1 Minute Gr | 1–6 Minutes Rec | 1–6 Minutes Gr | Total Rec | Total Gr |
|---|---|---|---|---|---|---|---|---|
| 1① | Oleic acid | 0.450 | 0.097 | 0.078 | 0.158 | 0.069 | 0.255 | 0.072 |
| 2① | Oleic acid | 2.400 | 0.307 | 0.080 | 0.231 | 0.065 | 0.538 | 0.074 |
| 3 | Propylene glycol | 1.200 | 0.220 | 0.094 | 0.198 | 0.078 | 0.418 | 0.086 |
| | Oleic acid | 1.200 | | | | | | |
| 4 | Dipropylene glycol | 1.200 | 0.225 | 0.094 | 0.232 | 0.080 | 0.457 | 0.087 |
| | Oleic acid | 1.200 | | | | | | |
| 5② | Propylene glycol | 1.200 | 0.153 | 0.081 | — | — | — | — |
| | Oleic acid | 0.600 | | | | | | |
| | Oleic acid | 0.600 | — | — | 0.354 | 0.084 | 0.507 | 0.083 |
| 6① | ②Propylene glycol | 2.400 | — | — | — | — | 0.091 | 0.035 |
| 7① | ⑥Dipropylene glycol | 2.400 | — | — | — | — | 0.113 | 0.038 |
| 8① | Dodecyl benzene sulfonic acid | 2.400 | 0.213 | 0.063 | 0.147 | 0.053 | 0.360 | 0.059 |
| 9 | Propylene glycol Dodecyl benzene sulfonic acid | 1.200 | 0.233 | 0.074 | 0.172 | 0.070 | 0.405 | 0.072 |
| 10① | ③No collector | — | — | — | — | — | 0.087 | 0.021 |
| 11① | Triethanol amine | 2.400 | — | — | — | — | 0.144 | 0.078 |
| 12 | Triethanol amine | 1.200 | 0.374 | 0.083 | 0.216 | .069 | 0.590 | 0.078 |
| | Oleic Acid | 1.200 | | | | | | |
| 13① | Sucrose | 2.400 | — | — | — | — | 0.091 | 0.068 |
| 14① | Trihydroxy benzoic acid | 2.400 | — | — | — | — | 0.148 | 0.071 |
| 15 | Sucrose | 1.200 | 0.297 | 0.084 | 0.163 | 0.067 | 0.460 | 0.078 |
| | Oleic acid | 1.200 | | | | | | |
| 16 | Trihydroxy benzoic acid | 1.200 | 0.337 | 0.082 | 0.140 | 0.071 | 0.477 | 0.075 |
| | Oleic acid | 1.200 | | | | | | |

①Not an embodiment of the invention.
②The second 0.600 portion of oleic acid is added after collection of the 0–1 minute fraction.
③Two concentrates are combined and analyzed as one.

The data in Table VI demonstrates the effectiveness of the collector composition of the present invention in the flotation of difficult to float Arizona copper oxide ore.

EXAMPLE 7

Flotation of Mixed Oxide/Sulfide Copper Ore

A series of 30-g samples of -10 mesh copper ore from Canada are prepared. The make-up of the valuable portion of the ore is approximately 50 percent malachite [$Cu_2CO_3(OH)_2$] and 50 percent chalcopyrite [CuFeS2]. Each sample is ground along with 15 grams of deionized water in a rod mill (2.5 inch diameter with 0.5 inch rods) for 1000 revolutions. The resulting pulp is transferred to a 300 ml flotation cell. The pH of the slurry is adjusted to 9.0 by the addition of sodium carbonate. The hydroxy-containing compound, collector and frother are added as described in the previous examples.

The float cell is operated and samples are prepared and analyzed as described in Example 6. The results obtained are given in Table VII below.

TABLE VII

| Run | Collector | Dosage (kg/metric ton) | pH | Copper Recovery and Grade 0–1 Minute Rec | 0–1 Minute Gr | 1–6 Minutes Rec | 1–6 Minutes Gr | Total Rec | Total Gr |
|---|---|---|---|---|---|---|---|---|---|
| 1 | Diethanol amine | 0.100 | 9.0 | 0.457 | 0.090 | 0.079 | 0.080 | 0.536 | 0.089 |
| | Oleic acid③ | 0.100 | | | | | | | |
| 2① | Diethanol amine③ | 0.200 | 9.0 | — | — | — | — | 0.111 | 0.089 |
| 3 | Ethanol amine | 0.100 | 9.0 | 0.279 | 0.106 | 0.215 | 0.076 | 0.494 | 0.093 |
| | Oleic acid③ | 0.100 | | | | | | | |
| 4① | Ethanol amine③ | 0.200 | 9.0 | — | — | — | — | 0.089 | 0.092 |
| 5 | Ethanol amine | 0.100 | 9.0 | 0.243 | 0.097 | 0.099 | 0.079 | 0.342 | 0.097 |
| | Oleic acid③ | 0.100 | | | | | | | |

TABLE VII-continued

| Run | Collector | Dosage (kg/metric ton) | pH | Copper Recovery and Grade 0–1 Minute Rec | 0–1 Minute Gr | 1–6 Minutes Rec | 1–6 Minutes Gr | Total Rec | Total Gr |
|---|---|---|---|---|---|---|---|---|---|
| 6① | Oleic acid | 0.200 | 9.0 | 0.218 | 0.090 | 0.058 | 0.065 | 0.376 | 0.062 |

①Not an embodiment of the invention.

The data in Table VII above generally demonstrate the effectiveness of this invention in the flotation of mixed copper oxide/sulfide ores.

EXAMPLE 8

Flotation of Corundum

A series of 30-g samples of a −10 mesh mixture of corundum ($Al_2O_3$) and silica ($SiO_2$) are prepared. Each sample is ground and transferred to a 300 ml flotation cell as described in Example 7 with the exception that the sample is ground 2000 revolutions. The pH of the slurry is left at the natural pH of 7.4. Collector, hydroxy compound and frother are added and the float cell is operated as described in Example 7. Samples are obtained as described in Example 7 and are dried, weighed, pulverized and the aluminum content is determined by X-ray fluorescence. The results obtained are shown in Table VIII below.

TABLE VIII

| Run | Collector | Dosage (kg/metric ton) | Aluminum Recovery and Grade 0–1 Minute Rec | 0–1 Minute Gr | 1–6 Minutes Rec | 1–6 Minutes Gr | Total Rec | Total Gr |
|---|---|---|---|---|---|---|---|---|
| 1① | Oleic acid | 0.200 | 0.331 | 0.160 | 0.013 | 0.080 | 0.344 | 0.157 |
| 2① | Propylene glycol | 0.200 | — | — | — | — | 0.118 | 0.086 |
| 3 | Propylene glycol | 0.100 | 0.513 | 0.194 | 0.071 | 0.152 | 0.584 | 0.188 |
| | Oleic acid | 0.100 | | | | | | |
| 4① | Diethanol amine | 0.200 | — | — | — | — | 0.146 | 0.104 |
| 5 | Diethanol amine | 0.100 | 0.466 | 0.205 | 0.044 | 0.171 | 0.490 | 0.202 |
| | Oleic acid | 0.100 | | | | | | |

①Not an embodiment of the invention.

The data shown in Table VIII above demonstrates the effectiveness of the present invention in the separation of aluminum from silica by flotation.

EXAMPLE 9

Flotation of Various Oxide Ores

The general procedure described in Example 1 is followed with the exception that various oxide ores are used in place of the copper ore of Example 1. The results obtained are shown in Table IX below.

TABLE IX

Recoveries of Different Minerals as a Function of pH and Collector Composition Using Propylene Glycol and Oleic Acid at a Dosage of .012 kg/kg Each

| MINERAL | pH 10.00 |
|---|---|
| Pyrite, $FeS_2$ | 1.000 |
| Silica, $SiO_2$ | 0.086 |
| Bauxite, $Al(OH)_3$ | 0.913 |
| Cassiterite, $SnO_2$ | 1.000 |
| Hematite, $Fe_2O_3$ | 1.000 |
| Corundum, $Al_2O_3$ | 0.798 |
| Calcite, $CaCo_3$ | 1.000 |
| Rutile, $TiO_2$ | 1.000 |
| Chromite, $FeCr_2O_4$ | 1.000 |
| Dolomite, $CaMg(CO_3)_2$ | 1.000 |
| Apatite, | 1.000 |

TABLE IX-continued

Recoveries of Different Minerals as a Function of pH and Collector Composition Using Propylene Glycol and Oleic Acid at a Dosage of .012 kg/kg Each

| MINERAL | pH 10.00 |
|---|---|
| $Ca_5(Cl_1F)[PO_4]_3$ | |
| Galena, PbS | 1.000 |
| Chalcopyrite, $CuFeS_2$ | 1.000 |
| Chalcocite, $Cu_2S$ | 1.000 |
| Sphalerite, ZnS | 1.000 |
| Sylvite① | 0.703 |
| Pentlandite, Ni(FeS)② | 1.000 |
| Nickel Oxide (NiO) | 0.911 |

①Process carried out in saturated KCl solution at pH 12.1.
②Sample includes some pyrrhotite.

This example demonstrates the efficacy of the present invention in floating a broad range of oxide and sulfide minerals. Also demonstrated is the ability to distinguish these various minerals from silica, the major gangue constituent found with these minerals in natural ores.

EXAMPLE 10

This example uses the general Hallimond tube procedure outlined in Example 1 except that instead of using only pure mineral specimens in each run, a specific test consisted of running a pre-mixed sample of 10 percent malachite (or 10 percent chrysocolla) along with 90 percent silica. Copper assays were performed on flotation concentrate and flotation tailings using the acid dissolution procedure and D.C. plasma spectrometry as discussed in Example 3. The results are shown in Table Xa for malachite and Table Xb for chrysocolla. All runs were determined at a pH of 10.0 with the collector dosages as indicated.

TABLE Xa

Malachite/Silica Mixture Separation

| Collector | Dosage (kg/kg) | Cu Recovery | Cu Grade |
|---|---|---|---|
| Oleic acid① | 0.024 | 0.971 | 0.191 |
| Oleic acid① | 0.012 | 0.963 | 0.169 |
| Propylene glycol① | 0.024 | 0.212 | 0.712 |
| Propylene glycol | 0.012 | 0.892 | 0.387 |
| Oleic acid | 0.012 | | |
| Propylene glycol | 0.012 | 0.944 | 0.325 |
| Oleic acid | 0.006 | | |
| Propylene glycol | 0.012 | 0.971 | 0.248 |
| Oleic acid | 0.003 | | |
| Dodecyl benzene sulfonic acid① | 0.024 | 0.927 | 0.178 |
| Propylene glycol | 0.012 | 0.961 | 0.355 |
| Dodecyl benzene sulfonic acid | 0.012 | | |
| Dipropylene glycol① | 0.024 | 0.438 | 0.133 |
| Dipropylene glycol | 0.012 | 1.000 | 0.184 |
| Oleic acid | 0.012 | | |
| Ethylene glycol① | 0.024 | 0.114 | 0.579 |
| Ethylene glycol | 0.012 | 0.944 | 0.255 |
| Oleic acid | 0.012 | | |
| Trihydroxy benzoic acid① | 0.024 | 0.167 | 0.326 |
| Trihydroxy benzoic acid | 0.012 | 0.659 | 0.219 |
| Oleic acid | 0.012 | | |
| Diethylene glycol① | 0.024 | 0.183 | >0.900 |

TABLE Xa-continued

| Malachite/Silica Mixture Separation | | | |
|---|---|---|---|
| Collector | Dosage (kg/kg) | Cu Recovery | Cu Grade |
| Diethylene glycol | 0.012 | 1.000 | 0.401 |
| Oleic acid | 0.012 | | |
| Glucose① | 0.024 | 0.154 | >0.900 |
| Glucose | 0.012 | 0.886 | 0.442 |
| Oleic acid | 0.012 | | |
| Ethanol amine① | 0.024 | 0.078 | 0.799 |
| Ethanol amine | 0.012 | 0.990 | 0.309 |
| Oleic acid | 0.012 | | |
| Diethanol amine① | 0.024 | 0.050 | >0.900 |
| Diethanol amine | 0.012 | 0.892 | 0.404 |
| Oleic acid | 0.012 | | |
| Glycerol① | 0.024 | 0.359 | 0.721 |
| Glycerol | 0.012 | 0.775 | 0.407 |
| Oleic acid | 0.012 | | |
| Sucrose | 0.024 | 0.316 | >0.900 |
| Sucrose | 0.012 | 0.943 | 0.501 |
| Oleic acid | 0.012 | | |

①Not an embodiment of the invention.

TABLE Xb

| Chrysocolla/Silica Mixture Separation | | | |
|---|---|---|---|
| Collector | Dosage (kg/kg) | Cu Recovery | Cu Grade |
| Oleic acid① | 0.024 | 0.672 | 0.187 |
| Oleic acid① | 0.012 | 0.389 | 0.324 |
| Propylene glycol① | 0.024 | 0.255 | >0.900 |
| Dodecyl benzene sulfonic acid① | 0.024 | 0.370 | 0.232 |
| Propylene glycol | 0.012 | 0.691 | 0.533 |
| Oleic acid | 0.012 | | |
| Propylene glycol | 0.012 | 0.676 | 0.337 |
| Dodecyl benzene sulfonic acid | 0.012 | | |

①Not an embodiment of the invention.

It is apparent from Tables Xa and Xb that a number of hydroxy-containing compounds are effective in decreasing the amount of silica gangue floated and generally resulting in increased recovery and grade.

EXAMPLE 11

A series of samples containing 30 g of a −10 mesh (U.S.) mixture of 10 percent rutile ($TiO_2$) and 90 percent silica ($SiO_2$) are prepared. The remainder of the procedure is exactly the same as that used in Example 6.

TABLE XI

| Rutile and Silica Mixture | | | | | | | | |
|---|---|---|---|---|---|---|---|---|
| | | Dosage (kg/ | Titanium Recovery and Grade | | | | | |
| | | metric | 0–1 Minute | | 1–6 Minutes | | Total | |
| Run | Collector | ton) | Rec | Gr | Rec | Gr | Rec | Gr |
| 1① | Propylene glycol | 0.400 | 0.044 | 0.066 | 0.012 | 0.021 | 0.056 | 0.054 |
| 2 | Propylene glycol | 0.400 | 0.674 | 0.099 | 0.062 | 0.014 | 0.736 | 0.092 |
| | Oleic acid | 0.100 | | | | | | |
| 3① | Diethanol amine | 0.400 | 0.048 | 0.045 | 0.027 | 0.020 | 0.075 | 0.036 |
| 4 | Diethanol amine | 0.400 | 0.771 | 0.103 | 0.033 | 0.046 | 0.804 | 0.101 |
| | Oleic acid | 0.100 | | | | | | |
| 5① | Oleic | 0.100 | 0.449 | 0.075 | 0.061 | 0.025 | 0.510 | 0.069 |

TABLE XI-continued

| Rutile and Silica Mixture | | | | | | | | |
|---|---|---|---|---|---|---|---|---|
| | | Dosage (kg/ | Titanium Recovery and Grade | | | | | |
| | | metric | 0–1 Minute | | 1–6 Minutes | | Total | |
| Run | Collector | ton) | Rec | Gr | Rec | Gr | Rec | Gr |
| | acid | | | | | | | |

①Not an embodiment of the invention.

The data in Table XI above demonstrates the effect of the present invention in increasing titanium grade and recovery.

Example 12

Separation of Apatite and Silica

A series of 30-g samples of a −10 mesh (U.S.) mixture of 10 percent apatite ($Ca_5(Cl_1F)[PO_4]_3$) and 90 percent silica ($SiO_2$) are prepared. The remainder of the procedure is exactly the same as that used in Example 6. The natural ore slurry pH is 7.1.

TABLE XII

| Apatite and Silica Mixture | | | | | | | | |
|---|---|---|---|---|---|---|---|---|
| | | Dosage (kg/ | Phosphorus Recovery and Grade | | | | | |
| | | metric | 0–1 Minute | | 2–6 Minutes | | Total | |
| Run | Collector | ton) | Rec | Gr | Rec | Gr | Rec | Gr |
| 1 | Propylene glycol | 0.200 | 0.923 | 0.056 | 0.044 | 0.005 | 0.967 | 0.052 |
| | Oleic acid | 0.200 | | | | | | |
| 2 | Diethanol amine | 0.200 | 0.841 | 0.041 | 0.124 | 0.002 | 0.965 | 0.036 |
| | Oleic acid | 0.200 | | | | | | |
| 3 | Diethylene glycol | 0.200 | 0.929 | 0.038 | 0.030 | 0.002 | 0.959 | 0.038 |
| | Oleic acid | 0.200 | | | | | | |
| 4① | Oleic acid | 0.200 | 0.801 | 0.039 | 0.145 | 0.013 | 0.946 | 0.035 |
| 5① | Propylene glycol | 0.200 | — | — | — | — | 0.361 | 0.031 |
| 6① | Diethanol amine | 0.200 | — | — | — | | 0.397 | 0.033 |
| 7① | Diethylene glycol | 0.200 | — | — | — | — | 0.304 | 0.028 |

①Not an embodiment of the invention.

The data presented above demonstrates that the use of hydroxy-containing compounds of this invention with oleic acid (which is a recognized collector for the flotation of apatite) gives better grade and faster flotation kinetics than the oleic acid alone. The recoveries of apatite with all collectors is quite high although slight improvements are observed in all cases using the hydroxy-containing compounds of this invention. Likewise, grade is improved in each case with substantial improvement being shown in Run 1.

EXAMPLE 13

Flotation of Chalcopyrite Copper Ore

In this example, the effect of different alkanol amines on the flotation of copper ore in laboratory flotation cells is examined. Samples of copper ore from Western Canada containing 500 g per sample are prepared. The ore is relatively high grade and also contains significant amounts of silica gangue. A 500-g portion of the ore is ground with 257 g deionized water in a rod mill having 2.5 cm rods at about 60 revolutions per minute (RPM) for about 7 minutes. This produces a size distribution of 25 percent less than 100 mesh. Except as indicated in Table I, the alkanol amine is added to the mill prior to the grinding step. Lime is also added to the mill to produce the desired pH for the subsequent flotation.

The pulp is transferred to a 1500-ml Agitair Flotation cell outfitted with an automatic paddle removal system. The cell is agitated at 1150 RPM. The pH of the slurry is adjusted to 8.5 by the addition of additional lime, if necessary. The collector, potassium amyl xanthate unless specified otherwise in Table XIII, is added to the slurry at a dosage of 8 g per ton and the slurry is allowed to condition for one minute. A polyglycol ether frother, in the amount of 18 g per ton of dry ore, is then added and the slurry is allowed to condition for one additional minute.

The flotation cell is agitated at 1150 RPM and air is introduced at a rate of 4.5 liters per minute. Samples of the froth concentrate are collected for a period of eight minutes after the air is first introduced into the cell. These samples of the tailings and concentrate are dried overnight in an oven, weighed, and pulverized for analysis. After being pulverized, they are dissolved with the use of acid and the copper content is determined using a DC Plasma spectrometer. The assay data is used to determine fractional recoveries and grades using standard mass balance formulas. The recoveries represent the fractional amount of the specified mineral present that is recovered. Seleotivity is determined by dividing the copper recovery by the silica gangue recovery.

The data obtained is shown in Table XIII below.

TABLE XIII

| Run | Alkanol Amine | Dosage (kg/metric ton) | Copper Recovery | Silica Recovery | Selectivity |
|---|---|---|---|---|---|
| 1① | None | — | 0.654 | 0.135 | 4.8 |
| 2 | Ethanol amine | 0.020 | 0.663 | 0.114 | 5.8 |
| 3 | Diethanol amine | 0.020 | 0.677 | 0.087 | 7.8 |
| 4 | Triethanol amine | 0.020 | 0.669 | 0.096 | 7.0 |
| 5 | Propanol amine | 0.020 | 0.673 | 0.118 | 5.7 |
| 6 | Dipropanol amine | 0.020 | 0.683 | 0.093 | 7.3 |
| 7 | Isopropanol amine | 0.020 | 0.668 | 0.107 | 6.2 |
| 8 | Butanol amine | 0.020 | 0.682 | 0.127 | 5.4 |
| 9 | Diethanol amine | 0.040 | 0.648 | 0.079 | 8.2 |
| 10 | Diethanol amine | 0.080 | 0.617 | 0.074 | 8.4 |
| 11② | Diethanol amine | 0.020 | 0.668 | 0.093 | 7.2 |
| 12② | Diethanol amine | 0.040 | 0.627 | 0.089 | 7.2 |
| 13③ | Diethanol amine | 0.020 | 0.597 | 0.105 | 5.7 |
| 14③ | Diethanol amine | 0.040 | 0.544 | 0.095 | 5.8 |
| 15① ② | None | — | 0.660 | 0.137 | 4.8 |
| 16① ③ | None | — | 0.582 | 0.128 | 4.5 |
| 17④ | Diethanol amine | 0.020 | 0.658 | 0.100 | 6.6 |
| 18④ | Diethanol amine | 0.040 | 0.644 | 0.088 | 7.3 |

TABLE XIII-continued

| Run | Alkanol Amine | Dosage (kg/metric ton) | Copper Recovery | Silica Recovery | Selectivity |
|---|---|---|---|---|---|
| 19 | Isopropanol amine | 0.040 | 0.649 | 0.095 | 6.8 |
| 20⑤ | Diethanol amine | 0.020 | 0.658 | 0.117 | 5.6 |

①Not an embodiment of the invention.
②N-ethyl isopropyl thionocarbamate used as collector.
③Sec-butyl dithiophosphate used as collector.
④In this run, the amine is added to the flotation cell rather than grinding mill.
⑤In this run, the amine and collector are added to the flotation cell concurrently.

The data in Table XIII demonstrates that the practice of this invention is effective in decreasing the recovery of silica gangue and thus increasing the selectivity of the flotation prooess. The data also demonstrates that the practice of this invention can result in lower recovery of the desired copper mineral values. A comparison of Runs 3, 17 and 20 shows that addition of the amine in the grinding stage rather than in the flotation cell or concurrently with collector results in the highest recovery of high grade copper.

EXAMPLE 14

Flotation of Mixed Copper Ore

A series of 30-g samples of mixed copper sulfide ore from Nevada are prepared. The make-up of the valuable components of the ore is about 0.25 weight percent copper, about 0.004 weight percent molybdenum and about 4 g/metric ton gold. Each sample of ore is ground dry for about 20 seconds in a swing mill to about 12 percent greater than 100 mesh. The resulting ore is transferred to a 300 ml flotation cell and diluted with water.

The pH of the slurry is adjusted to 8.5 with lime. The alkanol amine as specified in Table XIV is added and the slurry is allowed to condition for one minute. Next, a first portion of the collector, sodium isopropyl xanthate, (0.050 kg/metric ton of ore) is added with an additional minute of conditioning. Next, the frother, a polyglycol ether, is added in an amount equivalent to 0.020 g per ton of dry ore and the slurry is allowed to condition an additional minute.

The float cell is agitated at 1800 RPM and air is introduced at a rate of 2.7 liters per minute. Samples of the froth concentrate are collected by standard hand paddling at 2.0 minutes after the start of the introduction of air into the cell. Next, a second dose of collector (0.025 kg/metric ton of ore) is added with one minute of conditioning and a six minute concentrate is collected. Samples of the concentrate and the tailings are combined and then dried and analyzed as described in the previous examples. The results obtained are presented in Table XIV below. In each case, the copper, gold, molybdenum and silica recoveries represent the total amount recovered at the 2 and 6 minute intervals.

TABLE XIV

| Run | Alkanol Amine | Dosage (kg/metric ton) | Copper Recovery | Gold Recovery | Molybdenum Recovery | Silica Recovery |
|---|---|---|---|---|---|---|
| 1 | Diethanol amine | 0.100 | 0.658 | 0.552 | 0.529 | 0.197 |
| 2 | Diethanol amine | 0.050 | 0.671 | 0.583 | 0.541 | 0.217 |
| 3 | Diethanol | 0.200 | 0.614 | 0.529 | 0.498 | 0.183 |

TABLE XIV-continued

| Run | Alkanol Amine | Dosage (kg/metric ton) | Copper Recovery | Gold Recovery | Molybdenum Recovery | Silica Recovery |
|---|---|---|---|---|---|---|
| | amine | | | | | |
| 4 | Monoethanol amine | 0.100 | 0.647 | 0.541 | 0.511 | 0.209 |
| 5 | Triethanol amine | 0.100 | 0.653 | 0.557 | 0.518 | 0.213 |
| 6 | Isopropanol amine | 0.100 | 0.651 | 0.549 | 0.523 | 0.217 |
| 7① | None | — | 0.624 | 0.533 | 0.489 | 0.250 |

①Not an embodiment of the invention.

The data shown above demonstrates the effectiveness of the process of the present invention in increasing the grade of recovered mineral values.

EXAMPLE 15

Flotation of Mixed Sulfide/Oxide Copper Ore

The general procedure outlined in Example 13 is followed using a southern Africa mixed sulfide/oxide copper ore. The sulfide copper ore is floated by the practice of this invention and the remaining oxide ore is recovered in a subsequent step such as leaching or oxide flotation. The sulfide minerals contained in this ore is quite small, less than about 0.22 weight percent of the total ore.

One modification to the procedure outlined in Example 13 is that the ore is ground for 700 revolutions to produce a size distribution of 13 percent greater than 100 mesh. The collector used is potassium amyl xanthate at a concentration of 0.025 kg/metric ton of ore. In each case, the alkanol amine used is diethanol amine in the amounts specified. The results obtained are shown in Table XV below.

TABLE XV

| Run | Dosage (kg/metric ton) | Copper Recovery | Lead Recovery | Zinc Recovery | Silica Recovery |
|---|---|---|---|---|---|
| 1① | None | 0.704 | 0.835 | 0.491 | 0.317 |
| 2 | 0.025 | 0.714 | 0.831 | 0.486 | 0.273 |
| 3 | 0.050 | 0.693 | 0.824 | 0.480 | 0.246 |
| 4 | 0.100 | 0.650 | 0.791 | 0.452 | 0.209 |
| 5 | 0.200 | 0.589 | 0.746 | 0.396 | 0.152 |

①Not an embodiment of the invention.

The data above again show that the practice of the present invention results in decreasing recoveries of silica gangue. With this particular ore, the recovery of the desired mineral values of lead and zinc also decline even at the lowest dosage of the alkanol amine.

EXAMPLE 16

Effect of Order and Manner of Addition of Collector and Hydroxy-Containing Compound The procedure outlined in Example 6 is followed with the exception that the apatite used is from a different source and contains about 30 percent apatite and about 70 percent silica. The hydroxy-containing compound used in each case is diethanol amine and the anionic collector is oleic acid. In each run, the manner in which the diethanol amine and oleic acid are added to the flotation system is varied. In Run 1, diethanol amine is added to the cell and it is allowed to condition for one minute. This is followed by the addition of the oleic acid followed by an additional minute of conditioning. In Run 2, the order of addition is reversed. In Run 3, diethanol amine and oleic acid are each added to the cell at the same time and in approximately the same physical location and allowed to condition for one minute. In Run 4, diethanol amine and oleic acid are mixed in a separate container and a salt is formed as indicated by the evolution of heat. This is added to the flotation cell and then conditioned for one minute. In Run 5, a condensate of excess fatty acids and diethanol amine available commercially as M-210 from The Dow Chemical Company is used in place of unreacted oleic acid and diethanol amine. In Runs 6 and 7, oleic acid is used alone. The results obtained are shown in Table XVI below.

TABLE XVI

| | | Apatite and Silica Mixture | | | | | | |
|---|---|---|---|---|---|---|---|---|
| | | Dosage (kg/metric ton) | Phosphorus Recovery and Grade | | | | | |
| | | | 0–1 Minute | | 2–6 Minutes | | Total | |
| Run | Collector | | Rec | Gr | Rec | Gr | Rec | Gr |
| 1 | Diethanol amine | 0.100 | 0.908 | 0.124 | 0.020 | 0.067 | 0.928 | 0.124 |
| | Oleic acid | 0.100 | | | | | | |
| 2 | Oleic acid | 0.100 | 0.876 | 0.126 | 0.042 | 0.083 | 0.918 | 0.124 |
| | Diethanol amine | 0.100 | | | | | | |
| 3 | Diethanol amine | 0.100 | 0.803 | 0.133 | 0.016 | 0.057 | 0.819 | 0.132 |
| | Oleic acid | 0.100 | | | | | | |
| 4① | Diethanol amine/Oleic acid salt | 0.200 | 0.703 | 0.126 | 0.024 | 0.94 | 0.727 | 0.115 |
| 5① | Condensate | 0.200 | 0.060 | 0.066 | 0.015 | 0.034 | 0.075 | 0.060 |
| 6① | Oleic acid | 0.200 | 0.881 | 0.089 | 0.033 | 0.027 | 0.904 | 0.087 |
| 7① | Oleic acid | 0.100 | 0.687 | 0.113 | 0.115 | 0.061 | 0.802 | 0.105 |

①Not an embodiment of the invention.

Runs 1–3, embodiments of this invention clearly demonstrate its effectiveness. Run 4 shows that when the components of the invention are pre-mixed, the recovery of phosphorus obtained is substantially less than when oleic acid is used alone. Run 5 shows that a fatty acid/diethanol amine condensate is ineffective in this process.

What is claimed is:

1. A process for the recovery of mineral values by flotation comprising subjecting a particulate ore, which contains silica or siliceous gangue and is in the form of an aqueous slurry, to froth flotation in the presence of a collector and at least one additional flotation reagent comprising a lower alkanol amine in an amount effective to depress the flotation of the silica or siliceous gangue under conditions such that the minerals to be recovered are floated and recovered, with the proviso that the lower alkanol amine is not a constituent of a salt and is not premixed with the collector or any other flotation reagents prior to addition to said ore.

2. The process of claim 1 wherein an anionic collector derived from an acid selected from the group consisting of carboxylic, sulfonic, sulfuric, phosphoric and phosphonic acids is used.

3. The process of claim 2 wherein the ore is metallic oxide ore.

4. The process of claim 3 wherein the metallic oxide ore is selected from the group consisting essentially of iron oxide, copper oxide, phosphorus oxide, aluminum oxide, titanium oxide and nickel oxide ores.

5. The process of claim 2 wherein the anionic collector is derived from an acid selected from the group consisting of carboxylic acids and sulfonic acids.

6. The process of claim 5 wherein the collector comprises oleic acid, linoleic acid, linolenic acid, their salts and mixtures thereof.

7. The process of claim 5 wherein the collector comprises alkyl sulfonic acids, alkylaryl sulfonic acids, their salts and mixtures thereof.

8. The process of claim 7 wherein the anionic collector is selected from the group consisting of alkylated benzene sulfonic acid, alkylated sulfonic acid, alkylated diphenyl oxide monosulfonic acids, their salts and mixtures thereof.

9. The process of claim 2 wherein the collector is selected from the group consisting of linolenic acid, oleic acid, lauric acid, linoleic acid, octanoic acid, capric acid, myristic acid, palmitic acid, stearic acid, arachidic acid, behenic acid, 2-naphthalenic sulfonic acid, sodium lauryl sulfate, sodium stearate, dodecane sodium sulfonic acid, dodecyl sodium sulfate, dodecyl phosphate, chloride derivative of dodecyl phosphonic acid, 2-naphthoic acid, pimelic acid, 11-aminododecanoic acid, dodecyl benzyl sulfonic acid, hexadecyl sulfonic acid and mixtures thereof.

10. The process of claim 1 wherin the ore is a sulfide ore.

11. The process of claim 1 wherein the ore comprises both sulfur-containing and oxygen-containing minerals.

12. The process of claim 1 wherein the ore comprises at least one noble metal selected from the group comprising gold, silver and platinum group metals.

13. The process of claim 1 wherein a thiol collector selected from the group consisting of thiocarbonates, thionocarbamates, thiocarbanilides, thiophosphates, thiophosphinates, mercaptans, xanthogen formates, xanthic esters and mixtures thereof is used.

14. The process of claim 13 wherein the collector is selected from the group consisting of thiocarbonates, thionocarbamates and thiophosphates.

15. The process of claim 1 wherein the lower alkanol amine is selected form the group consisting of ethanol amine, propanol amine, butanol amine, diethanol amine, dipropanol amine, dibutanol amine, triethanol amine, tripropanol amine, tributanol amine and mixtures thereof.

16. The process of claim 15 wherein the alkanol amine is diethanol amine.

17. The process of claim 1 wherein the alkanol amine is added to the slurry before the collector is added.

18. The process of claim 1 wherein the particulate ore is subjected to a grinding step prior to being subjected to flotation.

19. The process of claim 18 wherein the alkanol amine is added to the grinding step.

20. A process for the recovery of minerals by froth flotation comprising grinding an oxide ore selected from the group consisting of iron oxide ores, copper oxide ores, titanium oxide ores, phosphorus oxide ores, aluminum oxide ores and nickel oxide ores wherein the ore contains silica or siliceous gangue: slurrying the ore in an aqueous medium: and subjecting the slurry to froth flotation in the presence of a collector selected from the group consisting of oleic acid, linolenic acid, linoleic acid and mixtures thereof and a hydroxy-containing compound selected from the group consisting of ethanol amine, diethanol amine, triethanol amine and mixtures thereof under flotation conditions such that the minerals to be recovered are floated and recovered, and the flotation of the silica or siliceous gangue is depressed with the proviso that the hydroxy containing compound is not a constituent of a salt and is not premixed with the collector or any other flotation reagents prior to addition to said ore.

21. A process for the recovery of minerals by froth flotation comprising grinding a sulfide ore wherein the ore contains silica or siliceous gangue: slurrying the ore in an aqueous medium; and subjecting the slurry to froth flotation in the presence of a thiol collector and a hydroxy-containing compound selected from the group consisting of ethanol amine, diethanol amine, triethanol amine and mixtures thereof under flotation conditions such that the minerals to be recovered are floated and recovered, and the flotation of the silica or siliceous gangue is depressed with the proviso that the hydroxy containing compound is not a constituent of a salt and is not premixed with the collector or any other flotation reagents prior to addition to said ore.

* * * * *